United States Patent [19]

Ishii et al.

[11] Patent Number: 4,860,964

[45] Date of Patent: Aug. 29, 1989

[54] METHOD FOR CONTROLLING THE POSITION OF A WEB MOVING ALONG A GIVEN PATH AND APPARATUS FOR USE IN SUCH METHOD

[75] Inventors: Yoshiyuki Ishii; Shigehisa Shimizu, both of Kanagawa, Japan

[73] Assignee: Fuji Photo Film Co., Ltd., Kanagawa, Japan

[21] Appl. No.: 119,073

[22] Filed: Nov. 10, 1987

[30] Foreign Application Priority Data

Nov. 19, 1986 [JP] Japan ..... 61-275803

[51] Int. Cl.[4] ..... B65H 16/00

[52] U.S. Cl. ..... 242/57.1; 226/3; 226/19

[58] Field of Search ..... 242/57, 57.1; 226/22, 226/3, 15, 19, 20

[56] References Cited

U.S. PATENT DOCUMENTS

| | | | |
|---|---|---|---|
| 3,570,735 | 3/1971 | Kurz | 226/18 X |
| 3,910,527 | 10/1975 | Buhler et al. | 242/186 |
| 4,049,213 | 9/1977 | Hank et al. | 242/57.1 |
| 4,077,579 | 3/1978 | Seleski et al. | 226/20 X |

*Primary Examiner*—David Werner

*Attorney, Agent, or Firm*—Young & Thompson

[57] ABSTRACT

A method for controlling the position of a web moving along a given path, which is effective especially when a web travelling speed varies. In the method, the web travelling speed is detected and then a correction speed for correcting the meandering of the web is varied in accordance with the web travelling speed detected, so tha that the meandering of the web can be corrected with a constant accuracy independent of the variations of the web travelling speed.

4 Claims, 3 Drawing Sheets

METHOD FOR CONTROLLING THE POSITION OF A WEB MOVING ALONG A GIVEN PATH AND APPARATUS FOR USE IN SUCH METHOD

BACKGROUND OF THE INVENTION

1. Field of the Invention

The present invention relates to a method for controlling the position of a web moving along a given path and an apparatus for use in such method and, in particular, to a method and an apparatus for correcting the meandering of a thin, moving strip (which is hereinafter referred to as a web) such as paper, a plastic film, cloth, metal or the like when the web is wound or unwound.

2. Description of the Related Art

Conventionally, as an apparatus for controlling the position of a web travelling along a given path when the web is unwound from a roll into which it has been wound, there is known an apparatus (which is disclosed in Japanese Patent Publication No. 54-30360) in which the edge of the web unwound is detected by use of an edge detector such as a photo-electric switch, a high-pressure air injection pipe or the like located at a predetermined position in a web travelling path, and the roll is moved in the axial direction thereof in accordance with signals produced by the edge detector so as to be able to maintain the position of the web edge in a predetermined range after the web is unwound.

Also, there is known another prior art apparatus (which is disclosed in Japanese Patent Publication No. 49-33726) in which the meandering of a web occurring when the web is wound into a roll can also be corrected by means of a technique similar to the above-mentioned one.

However, in the above-mentioned prior art edge position controlling apparatus, due to the fact that the roll is moved in the axial direction thereof in accordance with correction commands corresponding to the displacements of the position of the web edge regardless of the web travelling speed, when the web travelling speed becomes slower, over correction of the edge position of the web than necessary is carried out to produce "hunting" and, on the other hand, when the web travelling speed becomes faster, the edge position control may be delayed.

SUMMARY OF THE INVENTION

The present invention aims at eliminating the drawbacks found in the above-mentioned prior art apparatus.

Accordingly, it is an object of the invention to provide a method which is capable of controlling the position of a web moving along a given path always with a constant accuracy even when a web travelling speed varies, as well as an apparatus for use in such method.

In order to accomplish the above object, according to the invention, there is provided a method in which the position of the edge of a continuously moving web is detected and the meandering of the web occurring when the web is wound or unwound can be corrected in accordance with the thus detected web edge position, characterized in that the travelling speed of the web when the web is wound or unwound is detected and the speed for correction of the position of the web is altered in accordance with the travelling speed detected so as to be able to properly correct the position of the web independent of variations of the web travelling speed.

In other words, the correction speed for controlling the position of the moving web is closely associated with the web travelling speed. Specifically, as the web travelling speed is accelerated, the controlling speed may also be accelerated accordingly, and, with the web travelling speed delayed, the controlling speed may also be delayed accordingly, thereby making it possible for the position control to be performed with a desired accuracy. Thus, according to the invention, the position controlling speed can be varied in accordance with the web travelling speed so as to be able to carry out a proper position control.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiment of a method for controlling the position of a web moving along a given path as well as an apparatus for use in such method according to the present invention with reference to the accompanying drawings.

Figure 1:
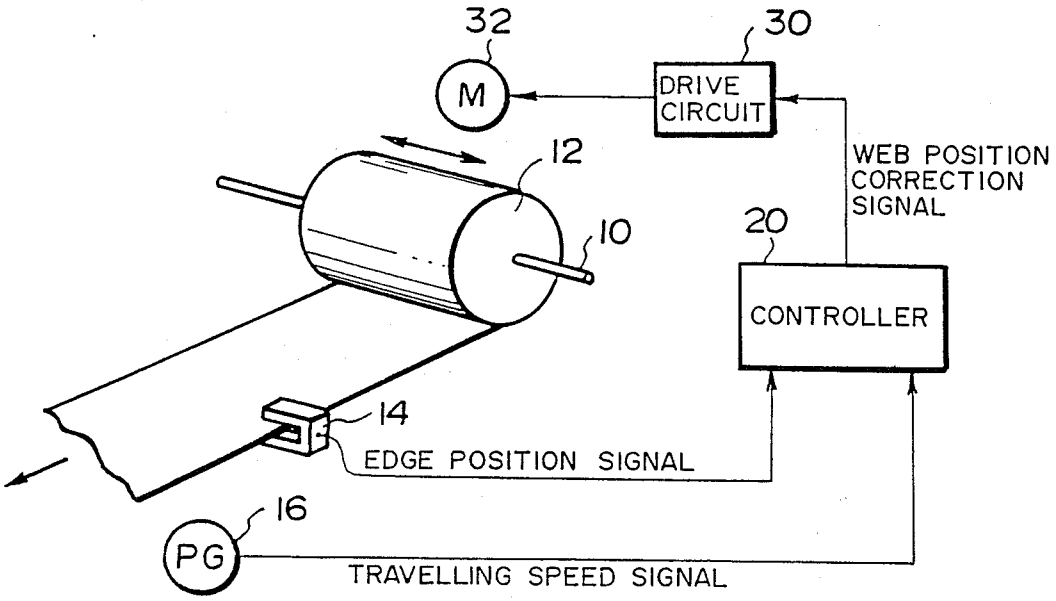
FIG. 1 is a view to show the general structure of an embodiment according to the invention.

Referring first to FIG. 1, there is shown a system structure view of an embodiment according to the invention, and, in this case, the embodiment is used to correct the meandering of a web 12 occurring when the web 12 wound around a shaft 10 is unwound.

In FIG. 1, at a predetermined position to correct the position of the web 12, there is located an edge position detector 14 and also there is provided a web travelling speed detector 16 in a web moving passage. The edge position detector 14 is composed of, for example, an image sensor and it is adapted to output to a controller 20 a web edge position signal representing the position of the edge of the web. On the other hand, the web travelling speed detector 16 is composed of, for example, a pulse generator and it is adapted to output to the controller 20 a web travelling speed signal (that is, a pulse signal having a frequency proportional to a web travelling speed) representing the moving speed.

The controller 20 decides in accordance with the above-mentioned web edge position signal whether the correction of the web edge position is necessary or not, when it decides the web edge position correction is necessary, it creates a web position correction signal so that the meandering condition of the web 12 can be corrected by a correction speed corresponding to the web travelling speed in accordance with the above-mentioned web travelling speed signal, and it applies the web position correction signal through a drive circuit 30 to a motor 32 which is adapted to move the shaft 10 in the axial direction thereof.

The motor 32, in accordance with the web position correction signal, moves the shaft 10 in the axial direction thereof to thereby correct the meandering of the web 12 in a prompt way.

Next, description will be given below of the concrete structure of the above-mentioned controller 20.

Figure 2:
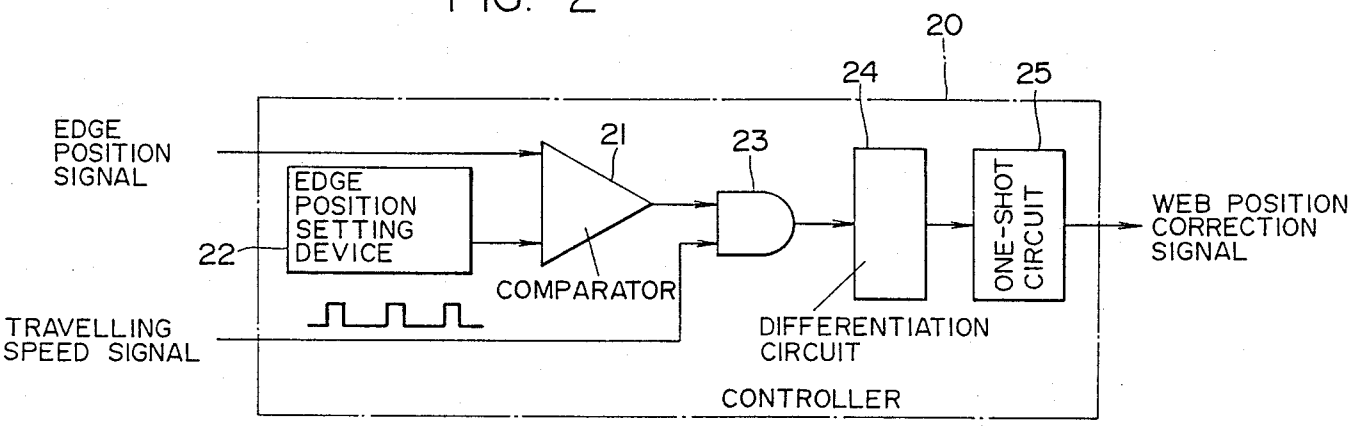
FIGS. 2 and 3 are respectively block diagrams to show in detail examples of a controller employed in the embodiment shown in FIG. 1; and, FIG. 4 is a perspective view of an example of another edge position controlling device.

Now, when the above-mentioned motor 32 is a pulse motor, then the controller 20 can be structured in such a manner as shown in FIG. 2. In this case, the controller 20 comprises a comparator 21, a web edge position setting device 22, and AND circuit 23, a differentiation circuit 24, and a one-shot circuit 25.

To one of inputs of the comparator 21 there is applied the web edge position signal, while to the other input thereof there is applied a target position signal of the web edge position previously set by the web edge position setting device 22. The comparator 21 compares these input signals, outputs a signal of a high level to the AND circuit 23 when the current web edge position has varied from the target position more than a limiting range, and otherwise outputs a signal of a low level to the AND circuit 23. To the other input of the AND circuit 23 there is applied a web travelling speed signal (a pulse signal).

Accordingly, when the current web edge position is varied from the target position more than the limiting range and thus the high level of signal is output from the comparator 21, then the AND circuit 23 becomes operable and it outputs to the differentiation circuit 24 a pulse signal that that is being applied to the other input thereof.

The differentiation circuit 24 differentiates the rising portion of the pulse signal input thereto and applies the differentiated pulse signal portion to the one-shot circuit 25 as a trigger signal. The one-shot circuit 25 outputs a pulse signal (a web position correction signal) of a given pulse width each time the trigger signal is input thereto.

In other words, when the controller 20 decides that the correction of the web edge position is necessary, then it outputs a pulse signal of a given pulse width corresponding to the pulse interval of the web travelling speed signal. And, the pulse signal is used to drive the pulse motor at a speed corresponding to the web travelling speed, so that the meandering of the web 12 can be corrected.

Figure 3:
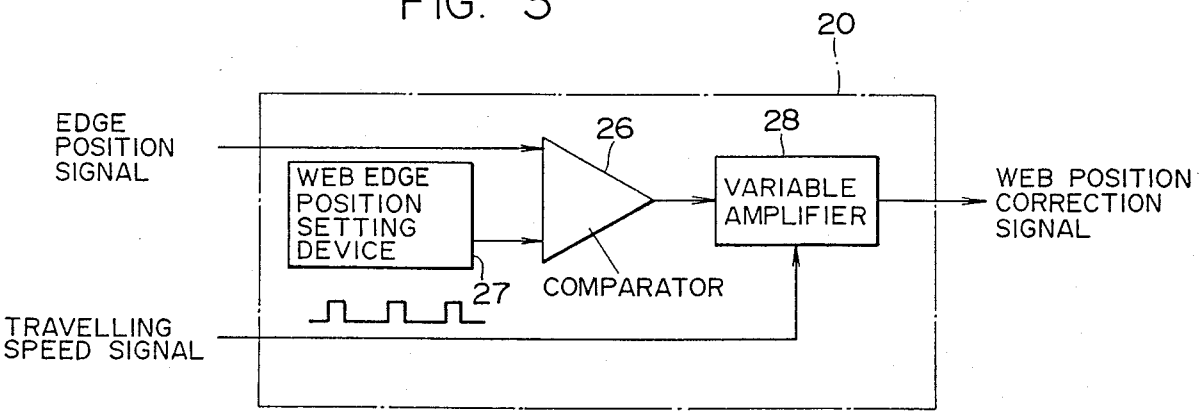

On the other hand, when the above-mentioned motor 32 is a servo motor, then the controller 20 can be structured in such a way as shown in FIG. 3. In this case, the controller 20 comprises a comparator 26, a web edge position setting device 27 and a variable amplifier 28. Here, since the comparator 26 and the web edge position setting device 27 are both similar to those shown in FIG. 2, the description thereof is omitted.

The variable amplifier 28 is adapted to amplify a binary signal applied thereto from the comparator 26 at a gain corresponding to the web travelling speed signal applied thereto from the travelling speed detector 16, such that the greater the speed is, the greater the gain is. It should be noted here that, when the binary signal from the comparator 26 is a signal of a low level, the output of the variable amplifier 28 is 0 irrespective of the gain thereof.

That is, in this controller 20, when it is decided that the web edge position is necessary to correct (when a signal of a high level is output from the comparator 26), the high level signal is amplified at a gain corresponding to the pulse period of the web travelling speed signal and then outputs the thus amplified signal as a web position correction signal. And, the servo motor is driven in accordance with the web position correction signal so as to be able to correct the meandering of the web 12.

In FIGS. 2 and 3, although the direction of correction of the web position (that is, the direction of rotation of the motor) is not described, it goes without saying that the direction of rotation of the motor is determined by the direction of displacement or meandering of the web position.

Figure 4:
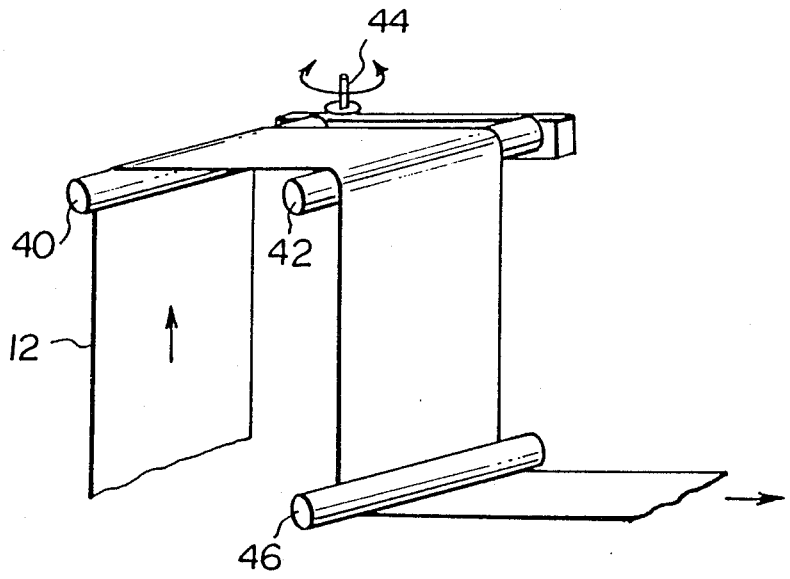

Also, in the illustrated embodiment, although the meandering of the web is corrected by moving the shaft 10 in the axial direction thereof, the invention is not limited to this. For example, as shown in FIG. 4, web position guide rolls 40, 42 may be rotated in the horizontal direction about a shaft 44 to thereby twist the web 12 so that the web 12 can be moved right and left over a carrying roller 46.

Further, in the illustrated embodiment, although the position of one of edges of the web is controlled so as to be located at a given position by means of edge position control (EPC), alternatively center position control (CPC) may be employed so that the central position of the web is controlled so as to be located at a given position. In the case of CPC, it is necessary to detect the positions of the two edges of the web.

In addition, in the illustrated embodiment, although the control is performed depending on whether the web meandering correction is necessary or not, if the web meandering correction is required, a signal which corresponds to the magnitude of the correction amount may be created, and then a web position correction signal may be created from the signal so that there can be obtained a correction speed corresponding to a web travelling speed.

As has been described hereinbefore, according to the method for controlling the position of a web moving along a given path and an apparatus for use in such method in accordance with the present invention, the meandering of the web can be corrected always with a constant accuracy independent of a web travelling speed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for detecting the position of the edge of a continuously moving web so as to control the position of said web in accordance with said detected edge position when said web is wound or unwound, in which a travelling speed is detected and then a speed for controlling the position of said web is varied in accordance with said detected travelling speed so that the meandering of said web can be corrected properly irrespective of said web travelling speed.

2. An apparatus for controlling the position of a web moving along a given path, comprising:

an edge position detector for detecting the position of the edge of said web;

correction means for correcting the meandering of said web occurring when said web is wound or unwound in accordance with the detection output of said edge position detector;

a speed detector for detecting the travelling speed of said web when said web is wound or unwound; and, control means for controlling a correction speed for correcting the meandering of said web by means of said correction means in accordance with said detection output of said speed detector such that, as said travelling speed is accelerated, said correction speed can also be accelerated accordingly.

3. An apparatus for controlling the position of a web moving along a given path as set forth in claim 2, in which said correction means includes decision means for deciding in accordance with said detection output of said edge position detector whether meandering correction is necessary or not, and a pulse motor for correcting the meandering of said web little by little in accordance with a web position correction signal in the form of a pulse output when said decision means decides that said web meandering correction is necessary, and also in which said control means is adapted to control the frequency of said web position correction signal in the form of a pulse in accordance with said web travelling speed.

4. An apparatus for controlling the position of a web moving along a given path as set forth in claim 2, in which said correction means includes signal generation means for generating a web position correction signal having a level indicating whether said web meandering correction is necessary or not or a level corresponding a meandering correction amount in accordance with said detection output of said edge position detector, and a servo motor for correcting the meandering of said web at a speed corresponding to the output level of said web position correction signal, and also in which said control means is adapted to control the output level of said web position correction signal in accordance with said web travelling speed.

* * * * *